US007284510B2

(12) United States Patent
Schiestl et al.

(10) Patent No.: US 7,284,510 B2
(45) Date of Patent: Oct. 23, 2007

(54) COMBUSTION-ENGINED SETTING TOOL

(75) Inventors: Ulrich Schiestl, Feldkirch (AT); Hans Gschwend, Buchs (CH); Iwan Wolf, Chur (CH)

(73) Assignee: Hilti Aktiengesellschaft, Schaan (LI)

( * ) Notice: Subject to any disclaimer, the term of this patent is extended or adjusted under 35 U.S.C. 154(b) by 48 days.

(21) Appl. No.: 11/225,727

(22) Filed: Sep. 12, 2005

(65) Prior Publication Data

US 2006/0054115 A1 Mar. 16, 2006

(30) Foreign Application Priority Data

Sep. 11, 2004 (DE) ..... 10 2004 043 950

(51) Int. Cl.
*B25C 1/08* (2006.01)

(52) U.S. Cl. ..... 123/46 H; 123/46 R

(58) Field of Classification Search ..... 123/46 R, 123/46 H

See application file for complete search history.

(56) References Cited

U.S. PATENT DOCUMENTS

| | | | | |
|---|---|---|---|---|
| 5,090,606 | A | 2/1992 | Torii et al. | |
| 5,133,329 | A | 7/1992 | Rodseth et al. | |
| 6,378,288 | B1 * | 4/2002 | Towfighi et al. | 60/39.6 |
| 6,425,354 | B1 * | 7/2002 | Buchel et al. | 123/46 R |
| 6,460,507 | B2 * | 10/2002 | Thieleke et al. | 123/260 |
| 6,463,894 | B2 * | 10/2002 | Hasler et al. | 123/46 R |
| 6,520,127 | B1 * | 2/2003 | Thieleke et al. | 123/46 R |
| 6,526,926 | B1 * | 3/2003 | Towfighi | 123/46 R |
| 6,532,917 | B2 * | 3/2003 | Thieleke et al. | 12/46 SC |
| 6,755,335 | B2 | 6/2004 | Fielitz | |
| 6,892,524 | B1 * | 5/2005 | Van Erden et al. | 60/39.6 |
| 6,968,811 | B2 * | 11/2005 | Rosenbaum | 123/41.2 |

FOREIGN PATENT DOCUMENTS

| | | |
|---|---|---|
| DE | 4243618 A1 | 6/1994 |
| DE | 19962711 A1 | 7/2001 |
| EP | 0544471 B1 | 6/1997 |

* cited by examiner

*Primary Examiner*—Willis R. Wolfe
*Assistant Examiner*—Jason Benton
(74) *Attorney, Agent, or Firm*—Abelman, Frayne & Schwab

(57) ABSTRACT

A combustion-engined setting tool for driving fastening elements in constructional components includes a member (32) arranged in the combustion chamber (13) for generating turbulence of an oxidant-fuel mixture filling the combustion chamber (13), an ignition unit (23) for igniting the oxidant-fuel mixture, a drive for at least temporarily driving the turbulence generating member (32), and a switch (22) for actuating the ignition unit (23) and actuated by the turbulence generating member (32).

9 Claims, 7 Drawing Sheets

COMBUSTION-ENGINED SETTING TOOL

BACKGROUND OF THE INVENTION

1. Field of the Invention

The present invention relates to a combustion-engined setting tool for driving fastening elements such as, e.g., nails, bolts, pins, in a constructional components and which includes a combustion chamber, means arranged in the combustion chamber for generating turbulence of an oxidant-fuel mixture filling the combustion chamber, an ignition unit for igniting the oxidant-fuel mixture, and drive means for a least temporarily driving the turbulence generating means.

2. Description of the Prior Art

In the setting tools described above, a portion of the liquid gas or another vaporable fuel, which is mixed with an oxidant, e.g., environmental air, is combusted in the tool combustion chamber. In order to obtain as high as possible drive-in energy from the combustion process, it is important that the combustion of the gas or gas mixture takes place under turbulent flow conditions. Only a turbulent combustion permits to obtain a necessary drive-in energy from the combustion process, producing a sufficiently rapid pressure increase in the combustion chamber for accelerating the setting piston to a degree necessary for driving a fastening element in. With a laminar combustion, the combustion process and the resulting pressure increase take place so slow that only a fraction of the required mechanical energy can be obtained from the combustion process.

European Patent EP-0 544471B1 discloses a combustion-engined setting tool having a combustion chamber for combusting a mixture of air and fuel gas and in which ventilator means is provided in the combustion chamber for generating turbulence therein. The ventilator means is driven by an electric motor which is supplied with electrical energy from a battery. The ventilator means is actuated by the head switch of the setting tool when the setting tool is pressed against a constructional component. The ignition unit is actuated for igniting the air-fuel mixture in the combustion chamber when an actuation switch is actuated, while the head switch is still closed.

The drawback of the setting tool of the European Patent consist in complicated and costly electronics which actuates and controls the ventilator means and which also actuates ignition. A further drawback consists in that several accumulators are needed, which increases the tool weight.

German Publication DE 199 62 711 A1 discloses a combustion-engined setting tool in which a separation plate with through-openings is arranged in the combustion chamber, dividing the combustion chamber in two chambers. An adjustment device is used for changing the distance between the separation plate and a rear wall that axially limits the combustion chamber, whereby the volumes of the forechamber and the main chamber change. In the forechamber, a first portion of the air-fuel mixture is ignited, with the flame jets penetrating into the main chamber through the openings in the separation plate, creating turbulence in the main chamber and igniting the air-fuel mixture therein.

The drawback of the tool disclosed in DE 199 62 711 A1 consists in that the combustion process is sensible to the environmental conditions such as, e.g., temperature, scavenging ratio of the combustion chamber, or the environmental pressure. This results from the fact that the turbulence is generated as a result of the combustion process itself, i.e., when the combustion in the forechamber is poor, then the combustion in the main chamber is even worse.

German Publication DE 102 26 878 A1 discloses a combustion-engined setting tool in which, as in the previously described case, the turbulence is generated by a perforated separation plate that remains static before and during the ignition process. After the combustion process ends, the separation plate and the rear wall are displaced in a direction toward the piston guide, so that the combustion chamber completely collapses. After the combustion chamber has collapsed, another, non-perforated plate is displaced as a result of application thereto a spring-biasing force from a location at the rear end of the setting tool remote from the piston guide up to the rear wall in order to scavenge the space before this plate with fresh air.

Here, likewise, the drawback consists in that the combustion process is sensible to the fluctuation of the environmental conditions such as, e.g., temperature, scavenging ratio of the combustion chamber, or the environmental pressure.

The object of the present invention is to provide a setting tool of the type described above and in which the drawbacks of the known tools are eliminated.

Another object of the present invention is to provide a setting tool of the type described above which would have a high energy efficiency.

SUMMARY OF THE INVENTION

These and other objects of the present invention, which will become apparent hereinafter, are achieved by providing a setting tool which would include switch means that actuates the ignition unit and that itself is actuated by the turbulence generating means.

Thus, according to the present invention, the ignition unit is directly controlled by the turbulence generating means. When the ignition unit is actuated by the actuation switch means and all of safety switches are closed, then ignition is effected automatically. The ignition takes place during the displacement of the turbulence generating means or as a result of the displacement of the turbulence generating means.

Thereby, ignition of the air-fuel mixture during a turbulent flow regime is insured, which permits to achieve a high energy efficiency of the combustion process. Complex electronics with separate switches for the ignition unit and the turbulence generating means is not any more necessary. Other switches or sensors can be provided, e.g., as safety switches in order to insure, e.g., that the setting tool is indeed pressed against a constructional component.

Advantageously, the turbulence generating means is formed as a member axially displaceable in the combustion chamber and which is actuated by a mechanical device. This measure permits to provide, in a simple way, turbulence in the air-fuel mixture in the combustion chamber, without use of electrical energy from batteries or accumulators, and which is noticeably stronger than the turbulence created, e.g., by flame jets passing through openings formed in a separation plate. In particular, according to the present invention, the turbulence is created in the entire combustion chamber and not only in a sub-chamber, as it takes place when the turbulence is created by flame jets passing through the openings in a separation plate. The mechanical device permits to obtain a pulse acceleration which can provide for displacement of the turbulence generating means in a time period from 1 msec to 200 msec, preferably, from 5 msec to 100 msec. The displacement or operation of the turbulence generating means for such a short time does not require much energy. With a mass of the turbulence generating means from about 1 g to 200, only an energy from about 1 mJ to 1 J is needed. Because of the small energy requirement, it can be obtained, e.g., by pressing the setting tool against the construction component, with the press-on energy being transmitted to the mechanical device, without tiring the user too much.

According to an advantageous embodiment of the present invention, the turbulence generating means is formed as a turbulence generating plate axially displaceable in the combustion chamber and provided, optionally, with openings. The turbulence generating plate can be displaced on a pipe or a rod, which is axially arranged in the combustion chamber, or be only connected with the force storing element, without any guidance. The openings in the turbulence generating plate can be formed as slots or holes. The turbulence generating plate can also be formed as a sieve plate. The turbulence generating plate can also be formed as an arched plate, with the concave side of the turbulence generating plate aligned preferably, in the direction of the pulsed movement. Such a turbulence generating plate has a high aerodynamic drag factor and, therefore, a strong turbulence when moving rapidly. It should be understood that with a collapsed combustion chamber, the displacement of the turbulence generating plate is possible or can take place only in at least partially expanded condition of the combustion chamber.

It is beneficial, when the switch means is provided in the region of a cylindrical wall that radially limits the combustion chamber. With this arrangement, detection of the turbulence generating means passing, in its axial displacement in the combustion chamber, past the switch means is used for actuation of the ignition unit.

Advantageously, the switch means is arranged on a combustion chamber wall that axially limits the combustion chamber. As the switch means, mounting wall, a front, in the setting direction, wall or an opposite rear wall can be used. With this arrangement, detection of engagement of the turbulence generating means with the combustion chamber wall or lifting of the turbulence generating means off the combustion chamber wall is used for the actuation of the ignition unit.

It is beneficial when the switch means is formed as sensor means, which enables a contactless detection of the turbulence generating means or a contactless switching on. Suitable, to this end, sensors are Hall sensors, light-sensitive sensors, or capacitance sensors.

The switch means can also be formed as mechanically actuated switch means, which reduces manufacturing costs of setting tool, without adversely affecting the inventive function. It is advantageous when there is provided time-delay means for delaying the ignition pulse of the switch means. Thereby, by arrangement of the switch means, in particular, in a region that adjoins the piston guide, it can be reliably determined that the turbulence generating means has been displaced by a sufficient amount before the ignition by the ignition unit takes place. As a result, a strong turbulence of the air-fuel mixture in the combustion chamber at the time of ignition prevails.

When set means for adjusting the time delay of the time-delay means is provided, then, in a simple way, the drive-in energy of the inventive setting tool can be adjusted. It has been shown that the produced energy depends on the time the ignition takes-place after actuation of the turbulence generating means. The set means can include, e.g., an adjusting wheel connected with the time-delay means and with which the setting or drive energy can be preset by the user, e.g., there can be provided, on the adjusting wheel, a scale which would indicate the setting energy in absolute (e.g., in J) or relative (e.g., as a %) values.

Instead of an adjusting wheel, the set means can include an adjusting lever or a pressure or sensor switch. Further, the set means can be formed as a sensor system or include such a sensor system. The sensor system can react, e.g., to the type of the constructional component or to the projecting length of a nail obtained from preceding nail settings, and adjust accordingly the setting energy by adjusting the time delay.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENT

Figure 1:
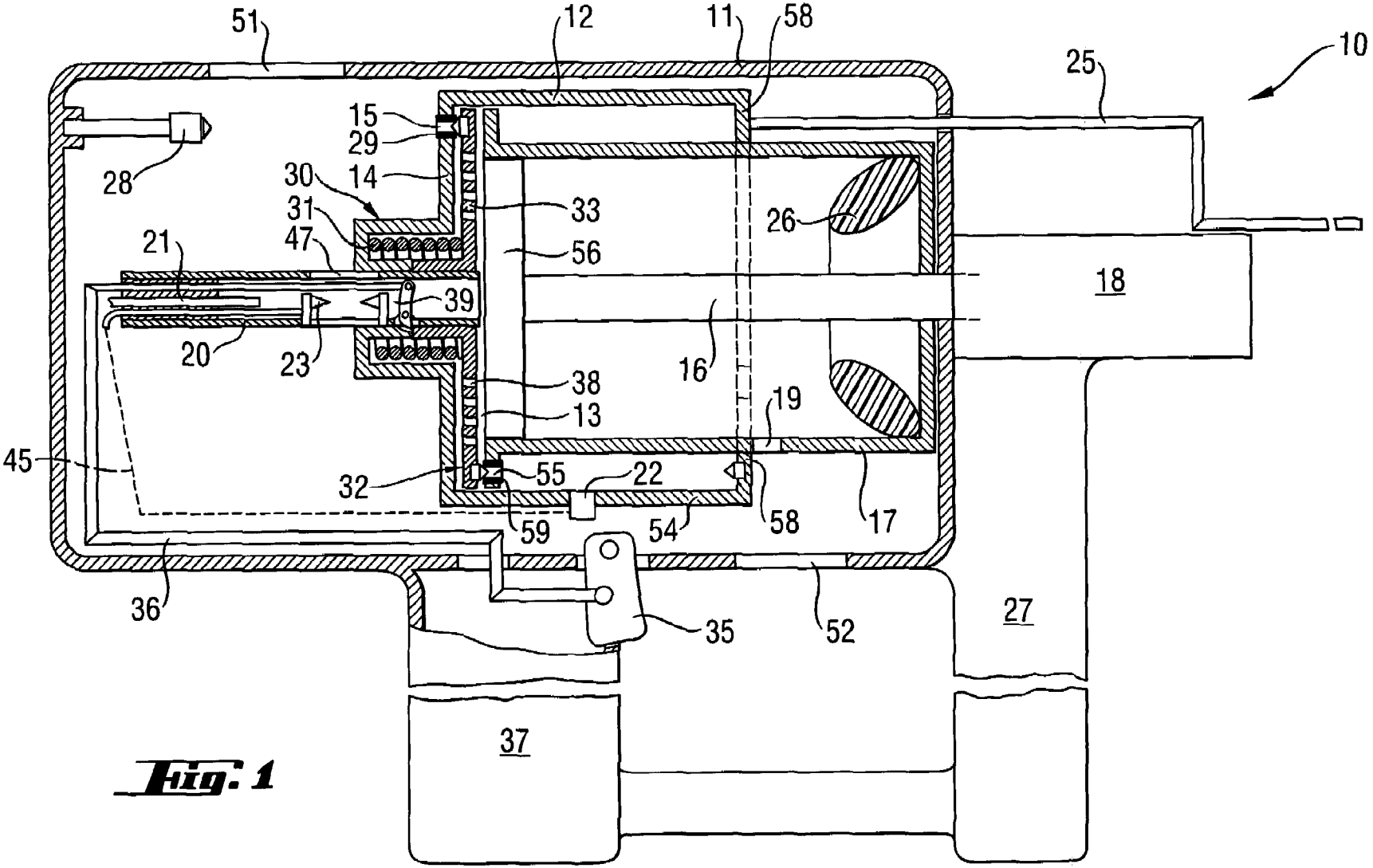
FIG. 1 a longitudinal, partially cross-sectional view of a setting tool according to the present invention in an inoperative position.

A setting tool 10 according to the present invention, which is shown in FIGS. 1-5, operates on a liquid or gaseous fluid.

The setting tool 10 has a housing 11 in which there is arranged a setting mechanism with which a fastening element such as a nail, a bolt or the like can be driven in a constructional component U (FIGS. 2-5) when the setting tool 10 is pressed against the constructional component U and is actuated.

The setting mechanism includes, among others, a combustion chamber casing 12 in which a combustion chamber 13 is expandable, a piston guide 17 in which a setting piston 16 is displaceably arranged, and a bolt guide 18 in which a fastening element can be displaced by setting direction end of the forward movable setting piston 16 and, thereby, be driven in a constructional component. The fastening element can, e.g., be stored in magazine 27 on the setting tool 10.

The combustion chamber 12 is displaceably arranged with respect to the piston guide 17 and is elastically biased by a spring, not shown in the drawings, in a direction toward the bolt guide 18 or in a direction of a collapsed position of the combustion chamber 13 shown in FIG. 1. The setting tool 10 further includes a press-on element 25 which is formed as a bar engaging with one of its end the combustion chamber casing 12, with the opposite end projecting from the housing 11 and extending, in an inoperative position of the setting tool 10 according to FIG. 1, beyond the bolt guide 18. The combustion chamber casing 12 is displaced, medium tight, with its rear wall 14 over a tubular element 20 in which an ignition element 23, such as a spark plug, is arranged and in which a fuel conduit 21 is arranged. The fuel conduit 21 is connected with a fuel reservoir, not shown in the drawings, e.g., a liquid gas capsule. In the region of the ignition element 23, the tubular element 20 has at least one opening 47 through which fuel 50 can flow into the combustion chamber 13 (please see FIG. 2) and through which a air-fuel mixture can reach the ignition element 23.

An electrical conductor 45 connects the ignition element 23 with switch means 22, which is formed as sensor switch means and with which an ignition process is actuated as it would be described more precisely below.

The switch means 22 is formed, in the embodiment shown in the drawings, as a Hall sensor arranged on a cylindrical wall 54 of the combustion chamber casing 12. Alternatively, the switch means 22 can also be formed, e.g., as an optical or capacitance switch. The switch means 22 can also be formed as a mechanical or electronic switch.

Figure 2:
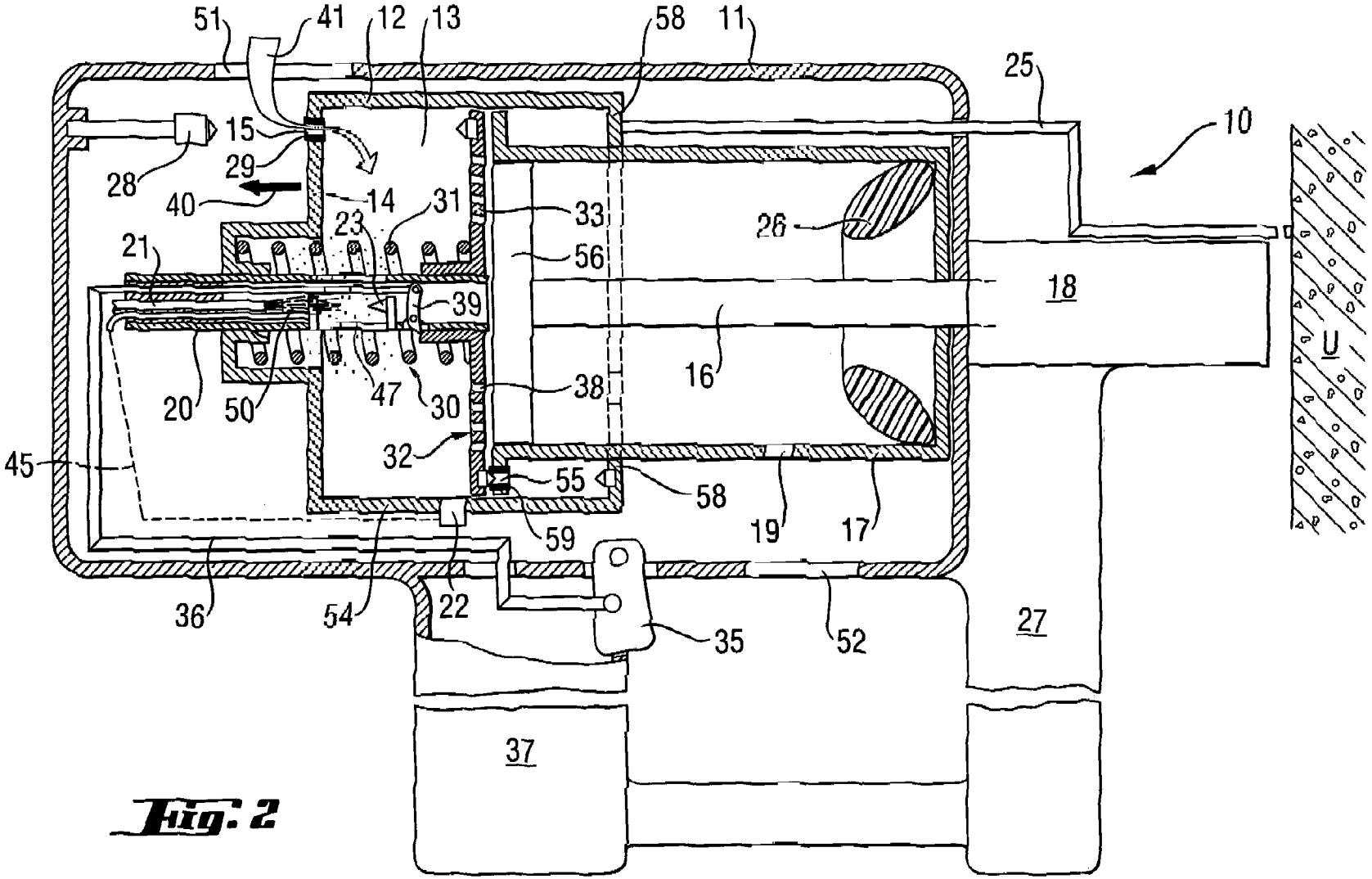
FIG. 2 a longitudinal, partially cross-sectional view of the setting tool shown in FIG. 1 in a position in which the tool is slightly pressed against a constructional component.

Through an air inlet 51 in the housing 11 and an inlet opening 15 in the rear wall 14 of the combustion chamber 13, air can be brought into the combustion chamber 13 (as shown with arrow 41) when the combustion chamber expands as a result of displacement of the combustion chamber casing 12 in the direction of arrow 40 (please see FIG. 2).

In the expanded condition of the combustion chamber casing 12 or the combustion chamber 13, a mechanical device, which is generally designated with a reference numeral 30, for a pulsed acceleration of turbulence generating means 32 is activated. The turbulence generating means 32 is formed as a turbulence generating plate 33 provided with openings 38. The mechanical device 30 includes a force storing element 31 which is formed as a spring engaging, with one of its end, the turbulence generating plate 33 and with its other end, the rear wall 14 of the combustion chamber 13. The turbulence generating means 32 or the turbulence generating plate 33 is displaced substantially friction-free along the tubular element 20 and is sufficiently spaced from the cylindrical wall 54 of the combustion chamber casing 12, so that no friction losses occur during displacement of the turbulence generating plate 33 in an axial direction in the combustion chamber 13.

In the initial or inoperative position of the setting tool 10 shown in FIG. 1, the turbulence generating plate 33 and the rear wall 14 are locate directly adjacent to each other at an end of the piston guide 17 remote from the bolt guide 18. The space of the combustion chamber 13 is reduced to a minimal gap, and the combustion chamber 13 is in collapsed condition.

When the setting tool 10, as shown in FIG. 2, is placed against a constructional component U, firstly, the free end of the press-on element 25 contacts the constructional component U. With the setting tool 10 being pressed against the constructional component U, the combustion chamber casing 12 is displaced in the direction of arrow 40 away from the piston guide 17, whereby the combustion chamber 13 expands. However, the turbulence generating plate 33 is not yet displaced but remains rather at the end of the piston guide 17 where it is held by a locking member 39. A switch rod 36 connects the locking member 39 with an actuation switch 35 provided on a handle 37 of the setting tool 10.

During the expansion process of the combustion chamber 13, on one hand, air flows into the combustion chamber 13 through the air inlet 51 and the inlet opening 15 in the direction of arrow 41 and, on the other hand, fuel 50 is fed into the combustion chamber 13 through the fuel conduit 21. The fuel conduit 21, only a section of which is shown in FIG. 2, is connected with a fuel reservoir, not shown. Metering of the fuel can be effected with a metering device which can be controlled mechanically or electronically.

Figure 3:
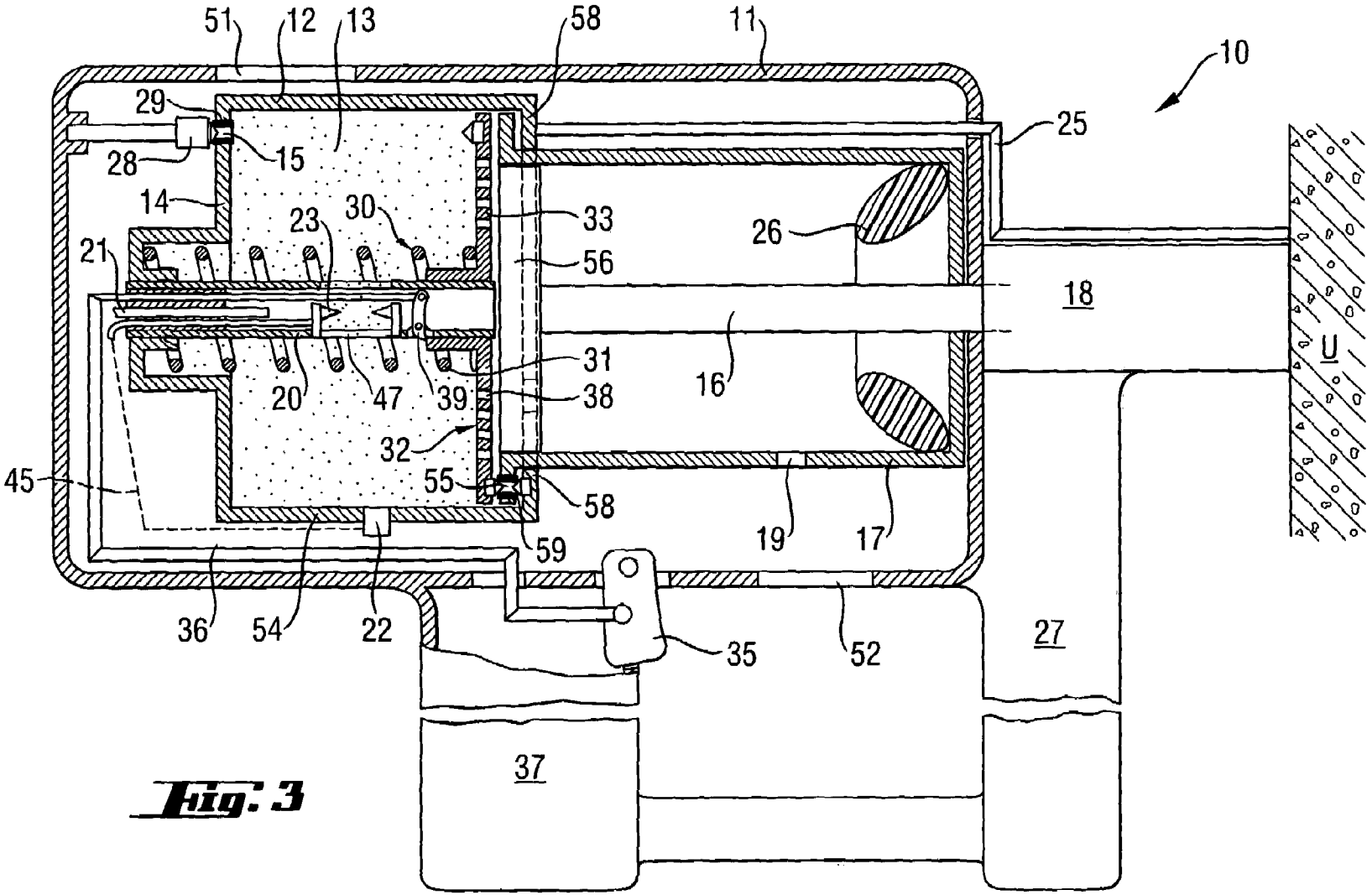
FIG. 3 a longitudinal, partially cross-sectional view of the setting tool shown in FIG. 1 in a position in which the tool is completely pressed against a constructional component.

When the setting tool 10, as shown in FIG. 3, is completely pressed against the constructional component U, the inlet opening 15, at the edge of which a sealing element 29 is provided, is closed by a seal 28, which can be provided, e.g., in the housing 11.

FIG. 3 shows the combustion chamber 13 in a completely expanded condition. However, the actuation switch 35 is not yet actuated. Air and gaseous fuel fills the combustion chamber 13.

Figure 4:
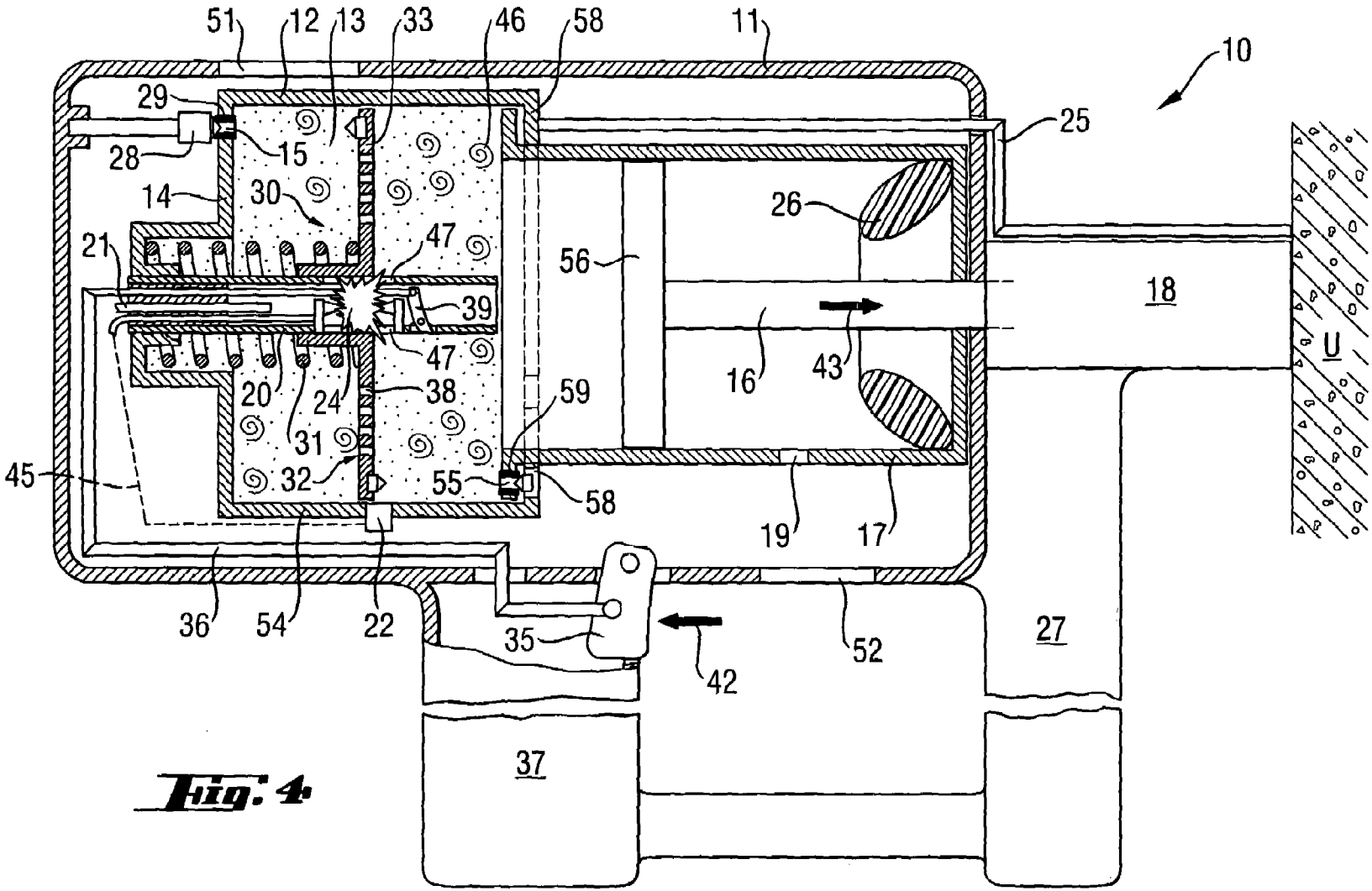
FIG. 4 a longitudinal, partially cross-sectional view of the setting tool shown in FIG. 1 in a position in which the tool is completely pressed against a constructional component, the trigger is actuated, and ignition has taken place.

In the position of the setting tool 10 shown in FIG. 4, the actuation switch 35 is actuated (arrow 42). The locking member 39 is displaced by the switch rod 36 in its release position, and the turbulence generating plate 33 is displaced in the combustion chamber 13 in the direction of the rear wall 14 under the biasing force of the force storing element 31 with acceleration from 1 m/sec$^2$ to 5,000 m/sec$^2$ and is displaced through the combustion chamber 13. As a result of the displacement of the turbulence generating plate 33, the air-fuel mixture, which fills the combustion chamber 13 is subjected to a strong turbulence 46. The acceleration forces, which are imparted by the force storing element 31 amounts to from about 1 N to 50 N. Alternatively or in addition to the mechanical switch rod, an electronic switching element can be provided for releasing the turbulence generating means 32 or the turbulence generating plate 33.

When the turbulence generating plate 33 reaches the switch means 22 or the Hall sensor, the later is actuated and communicates an ignition pulse to the ignition unit 23 through the conduit 45. The ignition unit 23 ignites the air-fuel mixture, as shown with reference numeral 24. If the switch means 22 is formed as a mechanical or electronic switch, it can likewise be actuated by the displaceable turbulence generating plate 33, closing the ignition circuit. In every case, the ignition takes place automatically and is actuated by the turbulence generating means 32 or the turbulence generating plate 33. Thereby, the ignition 24 always takes place during the displacement of the turbulence generating means 32 at a time when the air-fuel mixture in the combustion chamber 13 is subjected to a strong turbulence. Thereby, a very high energy yield during the combustion process is achieved.

The setting piston 16 is displaced by the expandable gases in the direction of arrow 43 toward the bolt guide 18, driving a fastening element in the constructional component U. At the end of the piston guide 17 adjacent to the bolt guide 18, there is provided an annular damping element 26 that damps or prevents overrun of the setting piston 16 at this end of the piston guide 17.

In the wall of the piston guide 17, there is provided an outlet opening 19 through which a major portion of the combustion gases can reach the exhaust opening 52 in the housing 11 and therethrough be released into environment when the piston plate 56 of the setting piston 16 is located between the outlet opening 19 and the damping element 26.

Figure 5:
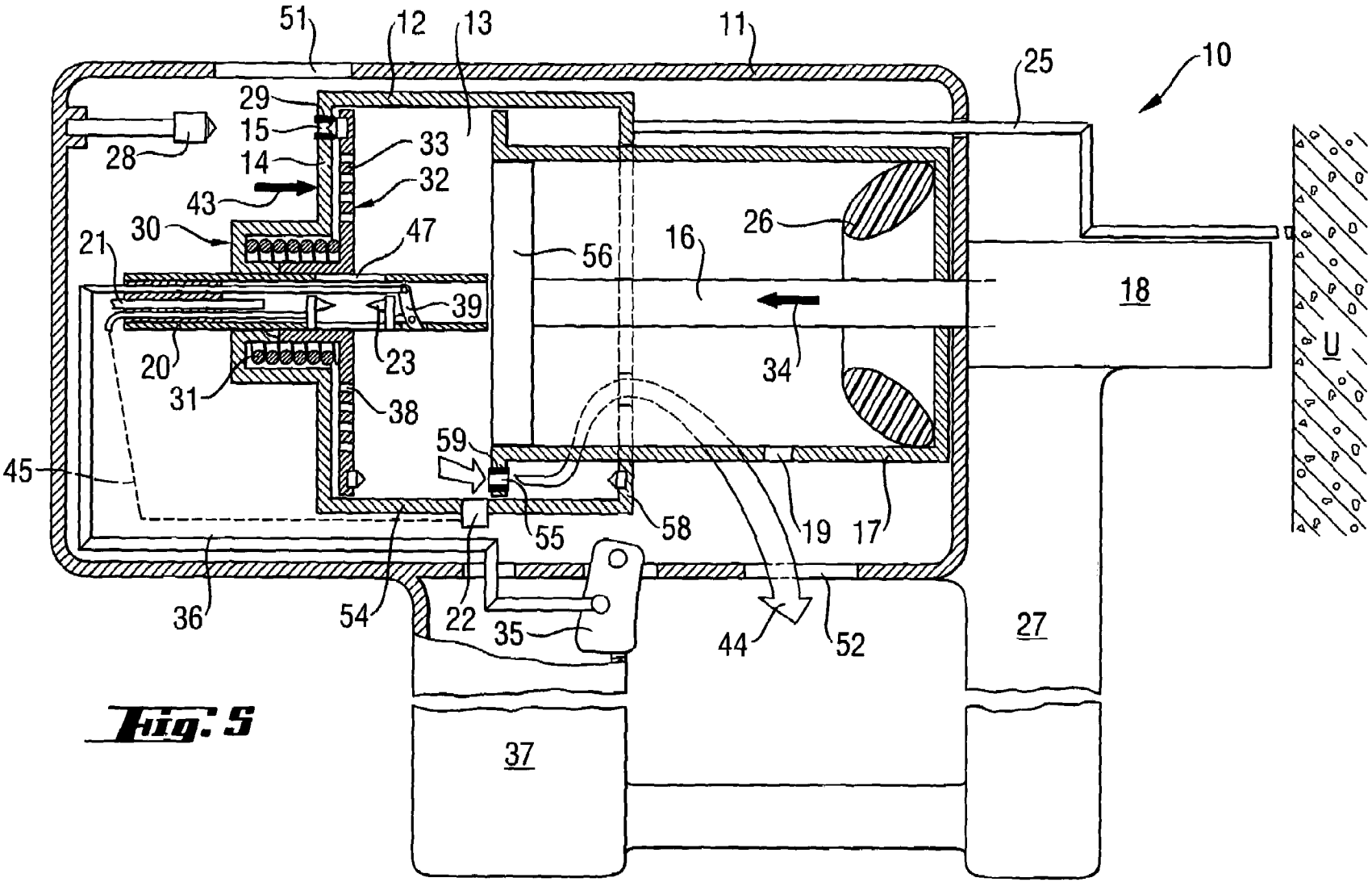
FIG. 5 a longitudinal, partially cross-sectional view of the setting tool shown in FIG. 1, in which the tool has been slightly lifted off the constructional component.

In FIG. 5, the setting piston 16 has already been displaced in the direction of arrow 48 to its initial position. This can take place, e.g., as a result of generation of under-pressure which is produced by cooling of residual combustion gases that remain in the combustion chamber 13, or by a return mechanism, not shown.

FIG. 5 shows a position in which the setting tool 10 is slightly lifted off the constructional component U. Thereby, an outlet opening 55, which was sealed with a sealing element 59 against an annular wall 58 of the combustion chamber casing 12, opens. The combustion gases, which remain in the combustion chamber 13, can flow through the outlet opening 55 and then through openings, not shown, in the annular wall 58 to the outlet opening 52 in the housing 11 and therethrough into environment, as shown with arrow 44. This process ends when the combustion chamber 13 completely collapses upon the setting tool 10 having been lifted form the constructional component 10, and the setting tool 10 assumes its initial inoperative position shown in FIG. 1. Then again, the turbulence generating plate 33 becomes locked by the locking element 39 on the tubular element 20, and the force storing element 31 becomes unloaded (the spring becomes released).

Figure 6:
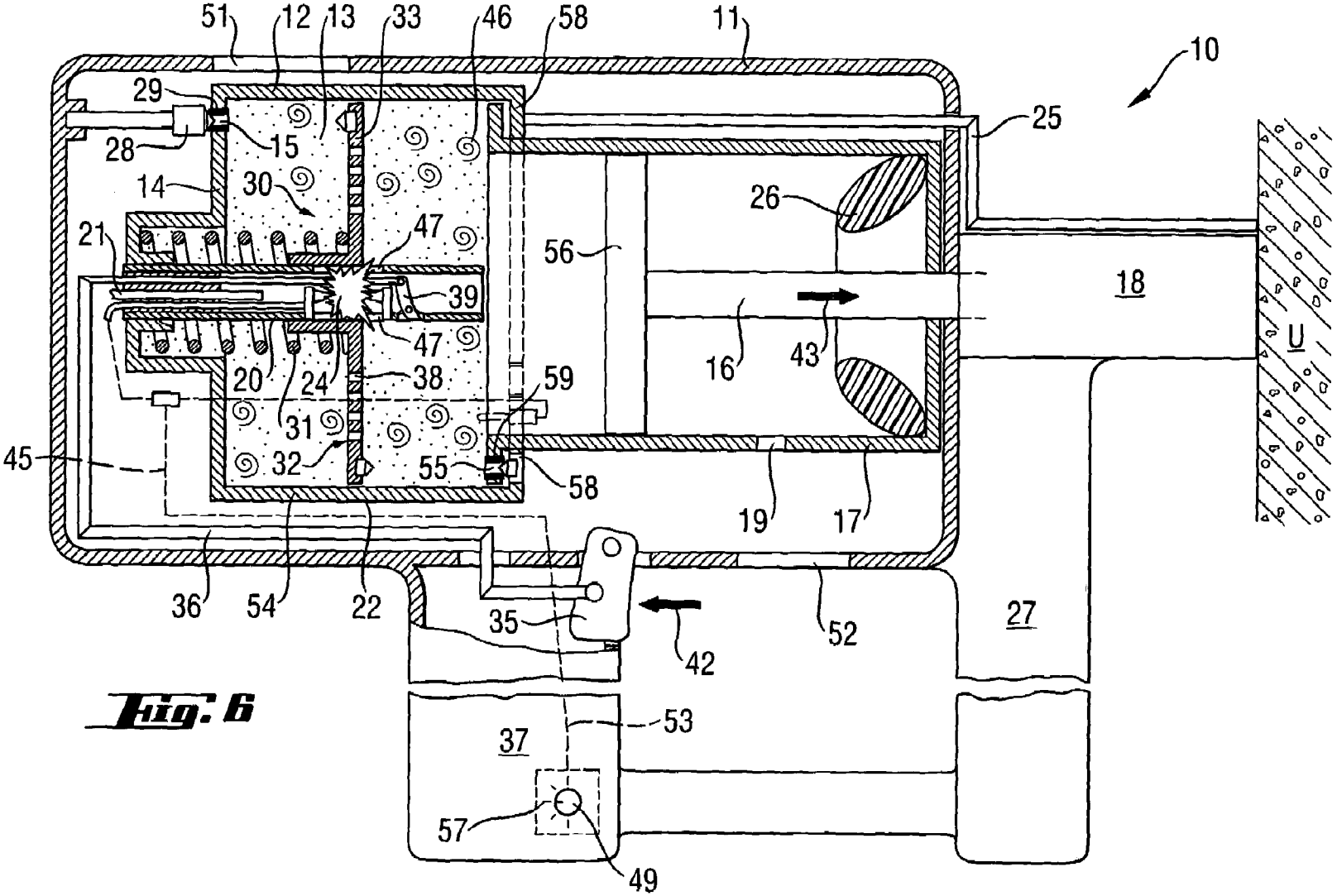
FIG. 6 a longitudinal, partially cross-sectional view of another embodiment of a setting tool according to the present invention in a position in which the tool is completely pressed against a constructional component, the trigger has been actuated, and ignition has taken place.

The setting tool 10, which is shown in FIG. 6, differs from the setting tool 10 shown in FIGS. 1-5 in that the switch means 22 is formed as an electromechanical switch that is arranged on an annular combustion chamber wall 58 adjacent to the piston guide 17. The conductor 45 connects the switch means 22 with the ignition unit 23. However, in this embodiment, time delay means 48 is provided in the conductor 45, which delays the further progression of the ignition pulse toward the ignition unit 23 or closing of the ignition circuit by about from 1 msec to 20 msec. Because of this time delay, the ignition 24 of the ignition unit 23 takes place not as soon as the turbulence generating plate 33 has been lifted off the combustion chamber wall 58 and the switch means 22 has been actuated but rather after the turbulence generating plate 33 has been displaced back a certain amount within the combustion chamber 13. The time-delay ignition insures that the turbulence generating means 32 at the time of ignition is still displaceable, and a strong turbulence of the air-fuel mixture still occurs.

Figure 7:
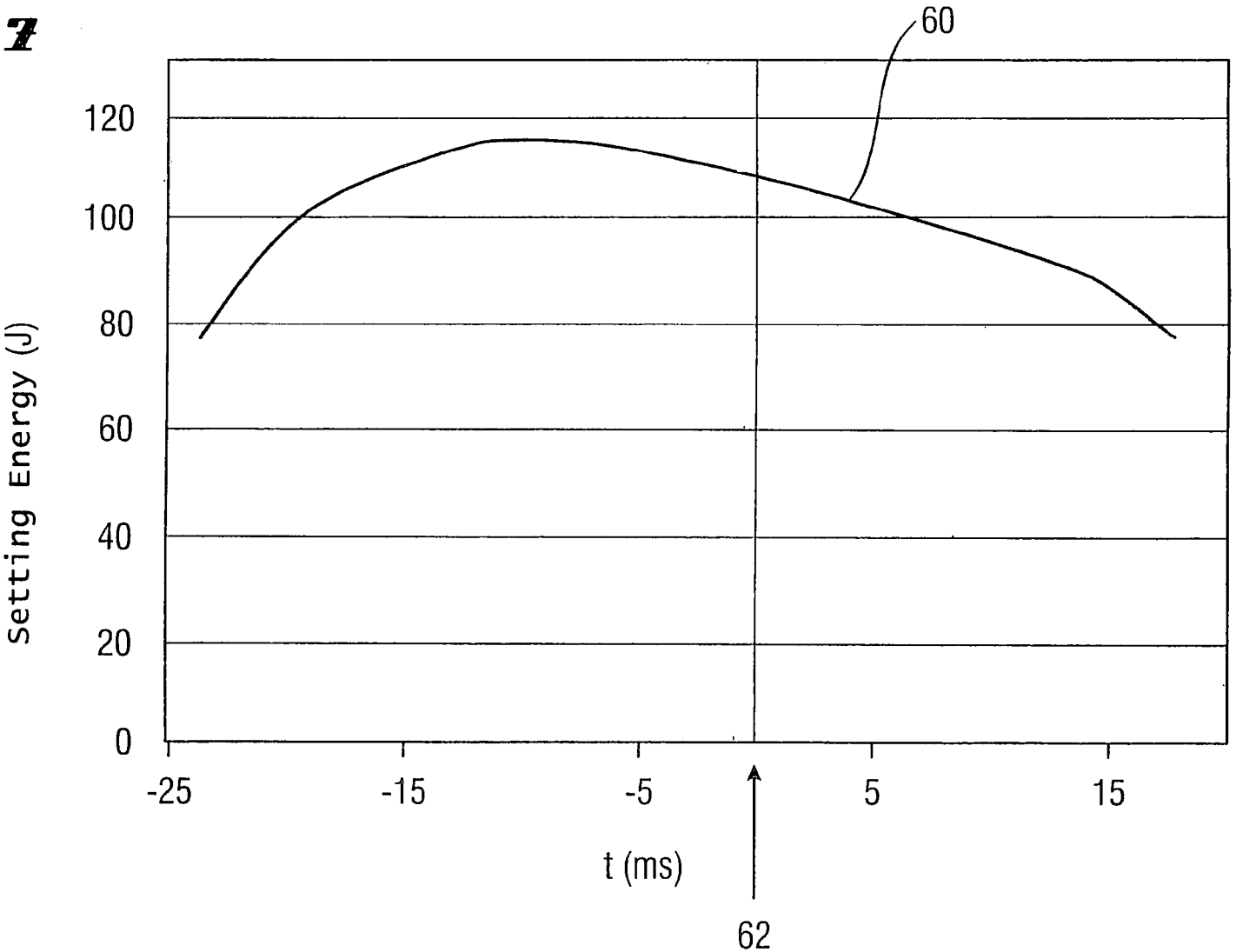
FIG. 7 a diagram illustrating the influence of the time of ignition on the setting energy of the setting tool shown in FIG. 6.

In the setting tool 10 shown in FIG. 6, there is further provided set means 49 in form of an adjusting wheel which is manually operated by the user. The electrical conductor 53 connects the set means 49 with the time delay means 48. The set means 49 is used for adjusting the setting energy by adjusting the time delay means 48 and thereby the time delay of the ignition. The set means 49 includes a scale 57 that can be graduated in absolute values, e.g., in joules (J) or in relative values, e.g., in %-readings for the setting energy. Thereby, the user can preset the setting or drive-in energy of the setting tool 10 with the adjusting wheel, using the scale 57. This adjustment or presetting of the setting energy is possible because in the setting tools, such as the setting tool 10, with a pulsed-driven turbulence generating means 32, the setting energy depends on the time the ignition takes place after the turbulence generating means 32 or the turbulence generating plate 33 has been actuated. This dependence will now be described with reference to the diagram of FIG. 7. In FIG. 7, the graph 60 shows dependence of the setting energy in J on time, wherein t=0 at point 62 indicates the time at which the displacement of the turbulence generating plate 33 ended. As can be seen, the setting energy is minimal in the initial phase of the displacement of the turbulence generating plate 33 between about t=−25 to −20 msec and between t=5−17 msec. A maximal setting energy is achieved at t being about from −15 msec to −5 msec.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A combustion-engined setting tool for driving fastening elements in constructional components, comprising:

a combustion chamber (13);

means (32) arranged in the combustion chamber (13) for generating turbulence of an oxidant-fuel mixture filling the combustion chamber (13);

an ignition unit (23) for igniting the oxidant-fuel mixture;

drive means for at least temporarily driving the turbulence generating means (32); and switch means (22) for actuating the ignition unit (23), the switch means (22) being actuated by the turbulence generating means (32).

2. A setting tool according to claim 1, wherein the turbulence generating means (32) is formed as a member axially displaceable in the combustion chamber (13), and wherein the setting tool further includes a mechanical device (30) for driving the turbulence generating means (32).

3. A setting tool according to claim 1, wherein the turbulence generating means (32) is formed as a turbulence generating plate (33) axially displaceable in the combustion chamber (13).

4. A setting tool according to claim 1, wherein the switch means (22) is arranged on a combustion chamber wall (58) that axially limits the combustion chamber (13).

5. A setting tool according to claim 1, wherein the switch means (22) is arranged in a region of the cylindrical wall (54) that radially limits the combustion chamber (13).

6. A setting tool according to claim 1, wherein the switch means (22) is formed as sensor means.

7. A setting tool according to claim 1, wherein the switch means (22) is formed as a mechanically actuated switch.

8. A setting tool according to claim 1, further comprising time delay means (48) for time-delaying an ignition pulse of the switch means (22).

9. A setting tool according to claim 8, comprising set means (49) for adjusting a time delay of the time delay means (48).

* * * * *